United States Patent [19]

Hayasaka et al.

[11] 4,437,890

[45] Mar. 20, 1984

[54] METHOD OF THE PREPARATION OF HIGH DENSITY SINTERED ALLOYS BASED ON IRON AND COPPER

[75] Inventors: Tadao Hayasaka, Chiba; Masahiro Suzuki, Adachi; Shigeru Ozawa, Tokiwadaira; Yoshiaki Takeya, Matsuhidai, all of Japan

[73] Assignee: Hitachi Powdered Metals Co., Ltd., Japan

[21] Appl. No.: 477,365

[22] Filed: Mar. 21, 1983

Related U.S. Application Data

[63] Continuation of Ser. No. 170,991, Jul. 18, 1980, abandoned.

[30] Foreign Application Priority Data

Jul. 28, 1979 [JP] Japan ..... 54-096389

[51] Int. Cl.[3] ..... B22F 3/00

[52] U.S. Cl. ..... 75/244; 419/27; 419/47

[58] Field of Search ..... 75/244; 419/27, 47

[56] References Cited

U.S. PATENT DOCUMENTS 3,971,632 7/1976 Menrad et al. ..... 75/244

FOREIGN PATENT DOCUMENTS 873269 6/1971 Canada ..... 75/244

50-56302 5/1975 Japan ..... 75/244

*Primary Examiner*—Brooks H. Hunt

*Attorney, Agent, or Firm*—McGlew and Tuttle

[57] ABSTRACT

A method of the preparation of an improved high-density sintered alloy composed mainly or iron and up to 50 wt. % of copper, in which boron is added in an amount of no less than 0.03% to suppress or limit the copper growth phenomenon during sintering. The alloys prepared by the present method undergo less dimensional changes during sintering and are thus of a very high density as compared with the conventional alloys of the same type.

26 Claims, 5 Drawing Figures

METHOD OF THE PREPARATION OF HIGH DENSITY SINTERED ALLOYS BASED ON IRON AND COPPER

This is a continuation, of application Ser. No. 170,991 filed July 18, 1980 now abandoned.

BACKGROUND OF THE INVENTION

The present invention relates to a method of the preparation of Fe-Cu based sintered alloys which undergo less dimensional changes during sintering and are thus of a very high density as compared with the conventional alloys of the same type, by suppressing the increase in dimension of the compacts which are mainly composed of iron and copper powders, said increase in dimension or copper growth taking place during sintering.

Among the iron-based sintering materials, the most available alloy element is copper, and Fe-Cu based materials constitute a basic component of a variety of sintered materials.

However, the Fe-Cu based materials have a technically troublesome feature in that a substantial growth therein takes place during sintering, which is referred to as the copper growth phenomenon. In other words, the sintered objects or parts now commercially available are prepared by compression molding of powders to powder compacts having the same dimension as that of the desired objects by means of a die that is dimensioned so as to allow for a dimensional change occurring during sintering, by sintering of the powder compacts, and subjecting the sintered compacts to post-treatments such as sizing or coining as the case may be. Accordingly, a too large or excessive dimensional change leads to a larger variation in the dimension of the compacts. As a result, it is very difficult to obtain parts having the required dimensional accuracy even by sizing.

As a consequence of such a growth during sintering, the density of the compacts under high pressures drop to such a degree that they are not used for mechanical parts.

For these reasons, the sintered material designed for use in or as mechanical parts should have an allowable dimensional change upon sintering of no more than 0.4% from various standpoints including an economical one, said percentage being calculated relative to the dimension of a die used.

Various attempts have so far been made to suppress the copper growth phenomenon. For instance, it has been proposed to attain such suppression by the addition of carbon, phosphorus, nickel or the like; however, no additive giving satisfactory results has yet been found. The addition of carbon has an effect to some extent in the case where the copper content is low. However, at a copper content of no less than 5%, it is impossible to attain a desired dimensional change. This is also true of the case where use is made of phosphorus. The use of phosphorus or carbon in a larger amount causes the sintered compact to be made harder, thus encountering difficulties in sizing upon sintering. Nickel is effective if used in a larger amount; however, it is expensive and unprofitable.

The results obtained by use of other elements are summarized en bloc in Table 1 set forth hereinafter.

Furthermore, it has been proposed to prevent the copper growth by low-temperature sintering. But this is also unpractical since the copper growth already begins at a temperature of 910° C. which is the alpha to beta transformation temperature of pure iron.

SUMMARY OF THE INVENTION

It is an object of the present invention to provide a method of the preparation of a high-density sintered alloy based on iron and copper, which is free from the above-mentioned drawbacks. More particularly, it is an object of the present invention to provide a method of the preparation of a high-density sintered alloy composed mainly of iron and up to 50% by weight of copper, characterized in that it contains no less than 0.03% of boron to suppress or limit the copper growth phenomenone during sintering. The sintered alloys prepared according to the present invention may be used as materials for bearings or like parts.

DETAILED DESCRIPTION OF THE INVENTION

Figure 1:
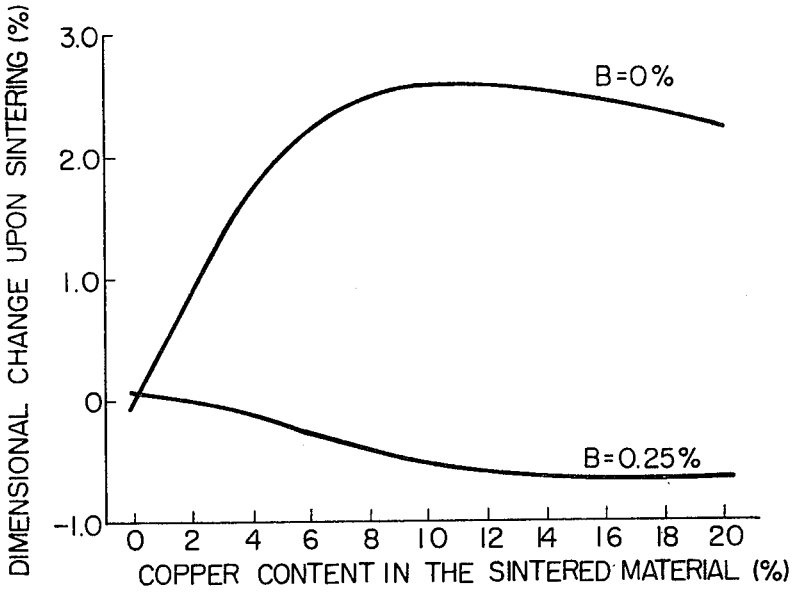
FIG. 1 is a graph illustrative of how the boron has an influence on the relation between the copper content and the dimensional change in the sintering material based on iron and copper.

Referring now to FIG. 1, there is shown a graph illustrative of how the boron has an influence on the dimensional change of the powder compact comprising a mixture of iron and copper powders during sintering, in which the dimensional change during sintering and the copper content in the sintering material are indicated on the ordinate and the abscissa, respectively. In the preparation of samples, there are well mixed together atomized iron powders having a particle size of no more than 100 mesh and a purity of no less than 99%, a given amount of electrolytic copper powders having a particle size of no more than 200 mesh and a purity of no less than 99.6% and 0.5% of zinc stearate serving as a lubricant. A given amount of ferroboron powders having particle size of no more than 250 mesh and a boron content of 20% is further added only when the sample is prepared containing boron. The resulting mixture is shaped into a $12.7\times31.8\times5$ mm test piece under a molding pressure of 5 t/cm$^3$. Sintering is carried out in an atmosphere containing gases obtained by the decomposition of ammonia at 1130° C. for 30 minutes in a sintering furnace.

As will be understood from FIG. 1, the growth coefficient of a sample containing no boron increases with increases in the copper content, reaches a peak at a copper content of 8–10%, and decreases afterward. Thus, the growth coefficient is 2% at a copper content of 5% and about 2.5% at a copper content of 8%, calculated relative to the dimension of a die. For the above-mentioned reasons, the copper content should be limited to 1% to reduce the dimensional change to no more than 0.4%. This imposes severe limitations on the properties of the alloy.

In the case of a sample containing 0.25% of boron, however, the results are that it contracts regardless of the magnitude of a copper content. It is also found that, when the contraction is limited to no more than 0.4%, the sample may contain up to 8% of copper.

Figure 2:
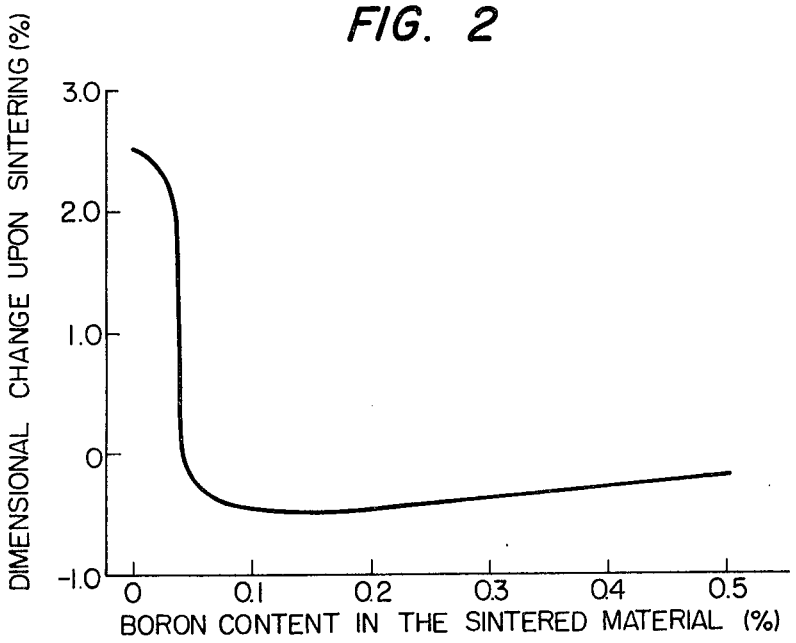
FIG. 2 is a graph illustrative of the relation between the boron content and the dimensional change.

Turning now to FIG. 2, there is shown a graph indicative of the relation between the boron content and the dimensional change with respect to a sample containing 8% of copper and exhibiting a great growth coefficient. This graph is used for the determination of a lower limit of the boron content required for the suppression of the copper growth phenomenon, and indicates that the boron is effective in an amount of only 0.03% or more.

Figure 3:
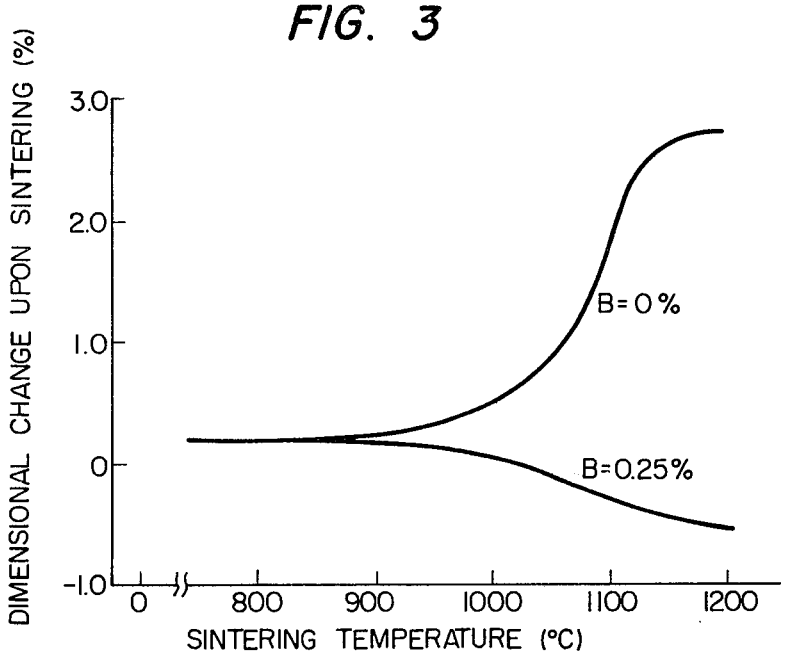
FIG. 3 is a graph illustrative of the relation between the sintering temperature and the dimensional change.

As will be seen from FIG. 3 representing the relation of the sintering temperature to the dimensional change, the growth coefficient of a sample free from boron increases with rises in the sintering temperature, while a boron-containing sample is rather subjected to contraction with rises in the sintering temperature. For simplicity, the expression "sintering temperature of zero" is used in this figure to indicate the green compact prior to sintering.

FIG. 3 also indicates that the copper growth initially occurs at around 800° C., and is moderate at a temperature exceeding the alpha to beta transformation temperature of pure iron and drastic at a temperature exceeding the melting point, 1083° C., of copper. Such a phenomenon is illustrated by the theories that iron and copper form together an alloy; the iron skeleton expands due to the diffusion of copper atoms into the crystal lattice of iron; and the iron skeleton expands due to the interruption and diffusion of the iron intergranular region caused by the invasion of the residual copper liquid phase into said region.

On the other hand, the addition of boron to the Fe-Cu system causes the boron to be co-precipitated as a ternary phase of Fe-Cu-B within the crystal particles of iron. This phase is rapidly developed at a temperature of no less than 1050° C., and serves to reduce the concentration of copper diffused within the crystal lattice of iron. As a result, no expansion of the iron lattice takes place. In the Fe-B system, the boron also serves to provide prevention of the diffusion of copper in the same manner as the case of carbon. It seems that these effects synergistically suppresses the copper growth phenomenon.

Figure 4:
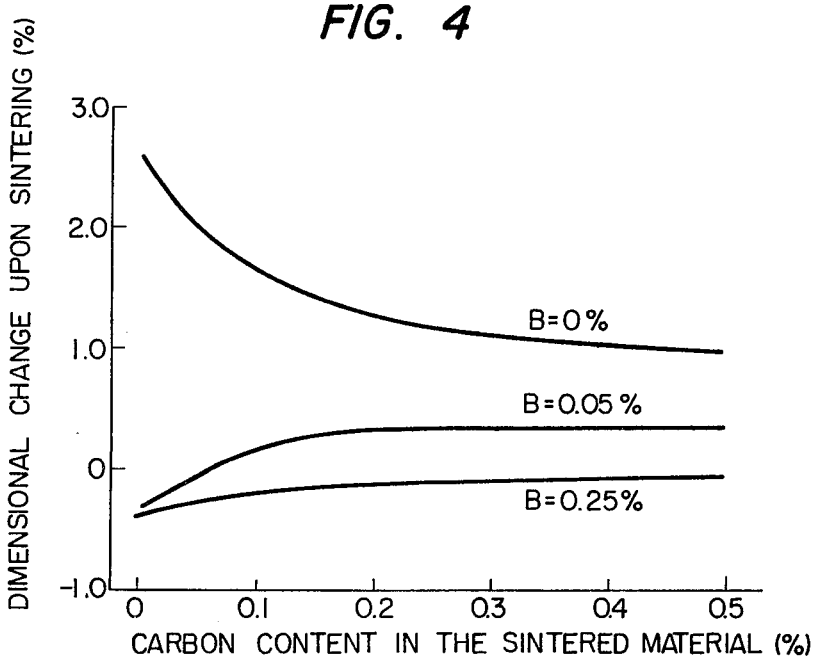
FIG. 4 is a graph illustrative of the carbon content and the dimensional change.

The influence that the carbon content has on the dimensional change was then determined by using as samples Fe-Cu sintered steel materials containing 8% of copper and exhibiting a large growth coefficient. Among the iron-based materials for mechanical parts produced according to powder metallurgy, such Fe-Cu sintered steel materials are mostly used. Determination was effected on the samples with and without boron. The results are shown in FIG. 4. The carbon was added as graphite, and the test pieces were prepared under the same conditions as those mentioned in connection with FIG. 1.

As will be evident from FIG. 4, the control sample free from boron indicates that the copper growth phenomenon is still insufficiently suppressed. In addition, the surface hardness of the sintered compact is on the order of no less than 70 according to Rockwell B scale, and is so high that no improvements in the dimensional accuracy may be expected by sizing.

On the contrary, the sample containing a suitable amount of boron indicates that its contraction is moderated by interaction with carbon, so that the dimensional change during sintering reaches substantially zero. Furthermore, the surface hardness of the resultant sintered compact is no more than 70 according to Rockwell B scale regardless of the magnitude of a carbon content. Thus, no problem arises in sizing.

Table 1 shows part of the results of experimentation of elements that seem to exhibit substantially the same behavior as the boron does. The reason for selecting these elements is that they belong to the same group as boron, and are similar thereto in the chemical properties and the alloy-forming properties. In the end, these elements other than boron are found unsatisfactory.

TABLE 1

Comparison of Various Elements

| Elements Added | Manner of Addition | Dimensional Change |
|---|---|---|
| None | — | 2.5% |
| Aluminium | Metal Powder | 6.1 |
| Sulfur | Fe—S | 3.3 |
| " | $MoS_2$ | 2.0 |
| Lithium | Stearate | 2.8 |
| Zinc | Metal Powder | 2.4 |
| Titanium | " | 2.4 |
| Lead | " | 2.3 |
| Silicon | Fe—Si | 2.0 |
| Tin | Metal Powder | 1.8 |
| Phosphorus | Fe—P | 1.2 |
| " | Red Phosphorus | 1.0 |
| Carbon | Graphite | 1.0 |
| Boron | $B_4C$ | −0.1 |
| " | Fe—B | −0.2 |
| " | Cu—B | −0.6 |

Amount added: 0.5% Matrix: Fe—0.8% Cu

Table 2 shows the experimental results obtained with respect to a number of iron-copper based sintered alloys the composition of which is beyond the foregoing composition. From these data, it is found that the concept of the present invention is applicable to all the iron-copper based alloys since the magnitude of growth is reduced or limited by the addition of B.

TABLE 2

| Alloys comprising the specified components in addition to copper and iron (%) | | | | | | Dimensional |
|---|---|---|---|---|---|---|
| C | Ni | Cr | Mo | Mn | B | Change in % |
| — | 1.4 | — | — | — | — | +2.00 |
| — | 1.4 | — | — | — | 0.15 | −0.09 |
| 0.30 | 1.4 | — | — | — | 0.15 | −0.06 |
| 0.30 | — | 2.0 | — | — | — | +1.45 |
| 0.30 | — | 2.0 | — | — | 0.15 | −0.02 |
| 0.10 | — | 0.7 | — | — | 0.15 | −0.25 |
| 0.05 | — | — | 1.5 | — | — | +1.87 |
| 0.05 | — | — | 1.5 | — | 0.15 | 0 |
| 0.20 | — | — | 1.5 | — | 0.15 | +0.20 |
| 0.20 | 3.0 | — | 0.5 | — | — | +1.57 |
| 0.20 | 3.0 | — | 0.5 | — | 0.15 | +0.18 |
| — | — | 1.0 | 0.2 | 0.6 | — | +1.46 |
| — | — | 1.0 | 0.2 | 0.6 | 0.15 | +0.39 |

As a result of concrete investigations of the influence that the boron has on the high copper content side of the Fe-Cu based material, it has been found that the density can be increased to the same level as in molten copper impregnation by the addition of a suitable amount of boron.

Figure 5:
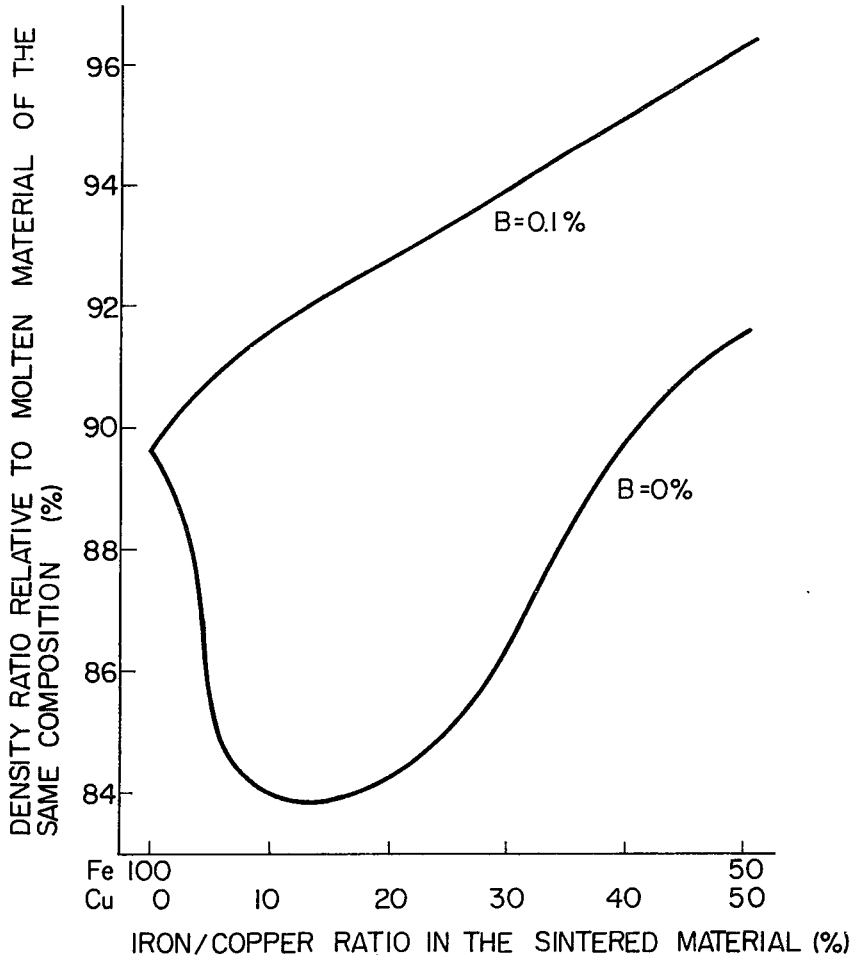
FIG. 5 is a graph illustrative of the copper content and the density ratio.

The results shown in FIG. 5 are of interest. That is to say, the density ratio of the material containing no boron drops sharply at a copper content between about 10–20% and increases gradually with increases in the copper content. However, the level of pure iron is ultimately attained at a copper content of 40%. In the material having a boron content of 0.1%, on the other hand, the density ratio increases uniformly with increases in the copper content, and reaches already a value of no less than 92% at a copper content of 15%.

In the prior art, this is only attained by molten copper impregnation. Thus, the present invention renders it possible to prepare at a single step a high-density and high-sealing sintered material equivalent to or better than that obtained by molten copper impregnation, without relying upon said impregnation.

As mentioned above, the present invention prevents the copper growth phenomenon in the sintered Fe-Cu steel by the addition of boron, and is thus of great value from a technical point of view.

We claim:

1. Method of preparing a high density iron and copper based sintered alloy from alloy material composed mainly of iron and by weight up to 50% copper, 0–0.5% carbon, 0–3% nickel, and 0–1.5% molybdenum in which boron is added to the alloy material in an amount of no less than 0.03% and sufficient to suppress or limit the copper growth phenomenon of the copper present during sintering, and then sintering the alloy material.

2. Method of claim 1, wherein by weight a copper content of up to 8% is present, and the sintering is carried out in a die under a dimensional change of the alloy material upon sintering of no more than 0.4% calculated relative to the dimension of the die.

3. Method of claim 1, wherein by weight a boron content of up to about 0.5% is present.

4. Method of claim 1, wherein by weight a boron content of up to about 0.25% is present.

5. Method of claim 1, wherein by weight carbon is also present in an amount of up to 0.5% and sufficiently relative to the amount of boron present for suppressing or limiting the copper growth phenomenon conjointly with the boron present.

6. Method of claim 5, wherein by weight a boron content of up to about 0.25% is present.

7. Method of claim 5, wherein by weight the boron is present in an amount sufficient to provide a sintered alloy having a surface hardness of no more than 70 according to the Rockwell B scale.

8. Method of claim 1, for preparing a high density iron and copper base sintered alloy from alloy material composed mainly of iron and by weight up to 50% copper, 0–0.5% carbon, 0–3% nickel, 0–1.5% molybdenum, 0–2% chromium, and 0–0.6% manganese, in which boron is added to the alloy in an amount of 0.03–0.5% and sufficient to suppress or limit the copper growth phenomenon of the copper present during sintering, and then sintering the alloy material.

9. High density iron and copper based sintered alloy composed mainly of iron and by weight up to 50% copper, 0–0.5% carbon, 0–3% nickel, 0–1.5% molybdenum, and boron in an amount of no less than 0.03% and sufficient to suppress or limit the copper growth phenomenon of the copper presenting during the sintering.

10. Alloy of claim 9, wherein by weight a copper content of up to 8% is present and the alloy constitutes the product of sintering the alloy material in a die under a dimensional change of the alloy material upon sintering of no more than 0.4% calculated relative to the dimension of the die.

11. Alloy of claim 9, wherein by weight the boron is present in an amount of up to about 0.5%.

12. Alloy of claim 9, wherein by weight the boron is present in an amount of up to about 0.25%.

13. Alloy of claim 9, wherein by weight carbon is also present in an amount of up to 0.5%.

14. Alloy of claim 13, wherein by weight the boron is present in an amount of up to 0.25%.

15. Alloy of claim 13, wherein the alloy has a surface hardness of no more than 70 according to the Rockwell B scale.

16. Alloy of claim 9, wherein the alloy has a surface hardness of no more than 70 according to the Rockwell B scale.

17. High density iron and copper based sintered alloy of claim 10, composed mainly of iron and by weight up to 50% copper, 0–0.5% copper, 0–3% nickel, 0–1.5% molybdenum, 0–2% chromium, 0–0.6% manganese, and 0.03–0.5% boron, with the balance being substantially iron.

18. Alloy of claim 17, wherein carbon is present.

19. High density iron and copper based sintered alloy consisting essentially of by weight up to 50% copper, 0–3% nickel, 0–1.5% molybdenum, 0–2% chromium, 0–0.6% manganese, and boron in an amount of no less than 0.03% with the balance being substantially iron.

20. Alloy of claim 19, wherein by weight at least one of the following is present: 3% or less of nickel, 1.5% or less of molybdenum, 2% of less of chromium, and 0.6% or less of manganese.

21. High density iron and copper based sintered alloy consisting essentially of by weight up to 50% copper, carbon in an amount of 0.5% or less, 0–3% nickel, 0–1.5% molybdenum, 0–2% chromium, 0–0.6% manganese, and boron in an amount of no less than 0.03%, with the balance being substantially iron.

22. Alloy of claim 21, wherein by weight at least one of the following is present: 3% or less of nickel, 1.5% or less of molybdenum, 2% or less of chromium, and 0.6% or less of manganese.

23. A bearing formed of the alloy of claim 19.

24. A bearing formed of the alloy of claim 20.

25. A bearing formed of the alloy of claim 21.

26. A bearing formed of the alloy of claim 22.

* * * * *

UNITED STATES PATENT AND TRADEMARK OFFICE

CERTIFICATE OF CORRECTION

PATENT NO. : 4,437,890

DATED : June 8, 1984

INVENTOR(S) : Tadao Hayasaka et al.

It is certified that error appears in the above-identified patent and that said Letters Patent is hereby corrected as shown below:

Column 6, Claim 17, line 3, "0-0.5%" copper" should read

-- 0-0.5% carbon --.

Signed and Sealed this

*Sixth* Day of *November 1984*

[SEAL]

*Attest:*

GERALD J. MOSSINGHOFF

*Attesting Officer*

*Commissioner of Patents and Trademarks*